United States Patent [19]

Richardson

[11] Patent Number: 4,689,593

[45] Date of Patent: Aug. 25, 1987

[54] TRANSFORMER WITH BALANCED TRANSMISSION LINES

[75] Inventor: Robert Richardson, South Woodham Ferrers, England

[73] Assignee: The Marconi Company Limited, Chelmsford, England

[21] Appl. No.: 770,554

[22] Filed: Aug. 29, 1985

[30] Foreign Application Priority Data

Sep. 1, 1984 [GB] United Kingdom ..... 8422125

[51] Int. Cl.[4] ..... H01F 27/02; H01F 27/28

[52] U.S. Cl. ..... 336/90; 333/24 R; 333/32; 336/200; 336/223; 336/225

[58] Field of Search ..... 333/32, 33, 24 R; 336/200, 205, 206, 223, 222, 233, 105, 107, 192, 225

[56] References Cited

U.S. PATENT DOCUMENTS

| | | | |
|---|---|---|---|
| 2,703,854 | 3/1955 | Eisler | 336/205 X |
| 3,102,245 | 8/1963 | Lawson, Jr. | 336/205 X |
| 3,609,613 | 9/1971 | Horn | 336/223 X |
| 3,611,233 | 10/1971 | Haideman, Jr. | 336/223 X |
| 3,826,967 | 7/1974 | Wilkinson et al. | 336/223 X |
| 4,342,976 | 8/1982 | Reysen | 336/200 X |

FOREIGN PATENT DOCUMENTS

| | | | |
|---|---|---|---|
| 889362 | 12/1959 | Canada | 336/223 |
| 0033441 | 8/1981 | European Pat. Off. . | |
| 0047497 | 3/1982 | European Pat. Off. . | |
| 1564756 | 7/1969 | France . | |
| 2335922 | 7/1977 | France . | |
| 2379891 | 10/1978 | France | 336/200 |
| 639111 | 6/1950 | United Kingdom . | |
| 1021344 | 3/1966 | United Kingdom | 336/206 |
| 1233894 | 6/1971 | United Kingdom | 336/200 |

*Primary Examiner*—Thomas J. Kozma

*Attorney, Agent, or Firm*—Spencer & Frank

[57] ABSTRACT

A transformer has a number of single turn primary windings 5 formed by printed circuit tracks on a flexible bendable sheet 3 which is wrapped around a core of the transformer. The primary windings are connected to output terminals 12 of an enclosure 1 of the transformer by another printed circuit board 8 having further conductive tracks on opposite sides thereof to form balanced transmission lines whose impedance is matched to the impedance of the primary windings.

4 Claims, 2 Drawing Figures

TRANSFORMER WITH BALANCED TRANSMISSION LINES

BACKGROUND OF THE INVENTION

This invention relates to a transformer having a number of primary windings. The invention arose in the design of a particular pulse modulator for feeding high voltage pulses to the output tube of a radar. In this particular pulse modulator it is proposed that a number of simultaneous pulses be fed to individual single turn primary windings of the transformer and it is important to provide transmission lines connecting directly with the primaries and matched to the impedance of the primarys.

SUMMARY OF THE INVENTION

According to the invention there is provided a transformer having a number of primary windings formed by conductive tracks on an insulating sheet wound around a core of the transformer.

The use of this technique results in "flat" conductors which have excellent properties of low RF resistance and good cooling properties. Furthermore, the fact that the primaries are formed on a single sheet can greatly facilitate assembly of the transformer.

By employing the invention it can become a simple matter to connect the primaries directly to matched impedance lines formed by opposed pairs of conductive tracks on opposite sides of a circuit board. The latter can be arranged to rest against the flexible sheet carrying the primary windings and suitable direct connections can be made between, on the one hand, the two tracks forming one of the feed lines and, on the other hand, the two ends of a primary winding associated with that feed line.

The circuit board and the conductive tracks on it preferably extend in the same direction as the axis of the primary windings. This arrangement allows a secondary to be wound or otherwise positioned around the primary windings.

BRIEF DESCRIPTION OF THE DRAWING

One way in which the invention may be performed will now be described by way of example with reference to the accompanying drawings in which.

DESCRIPTION OF THE PREFERRED EMBODIMENT

Figure 1:
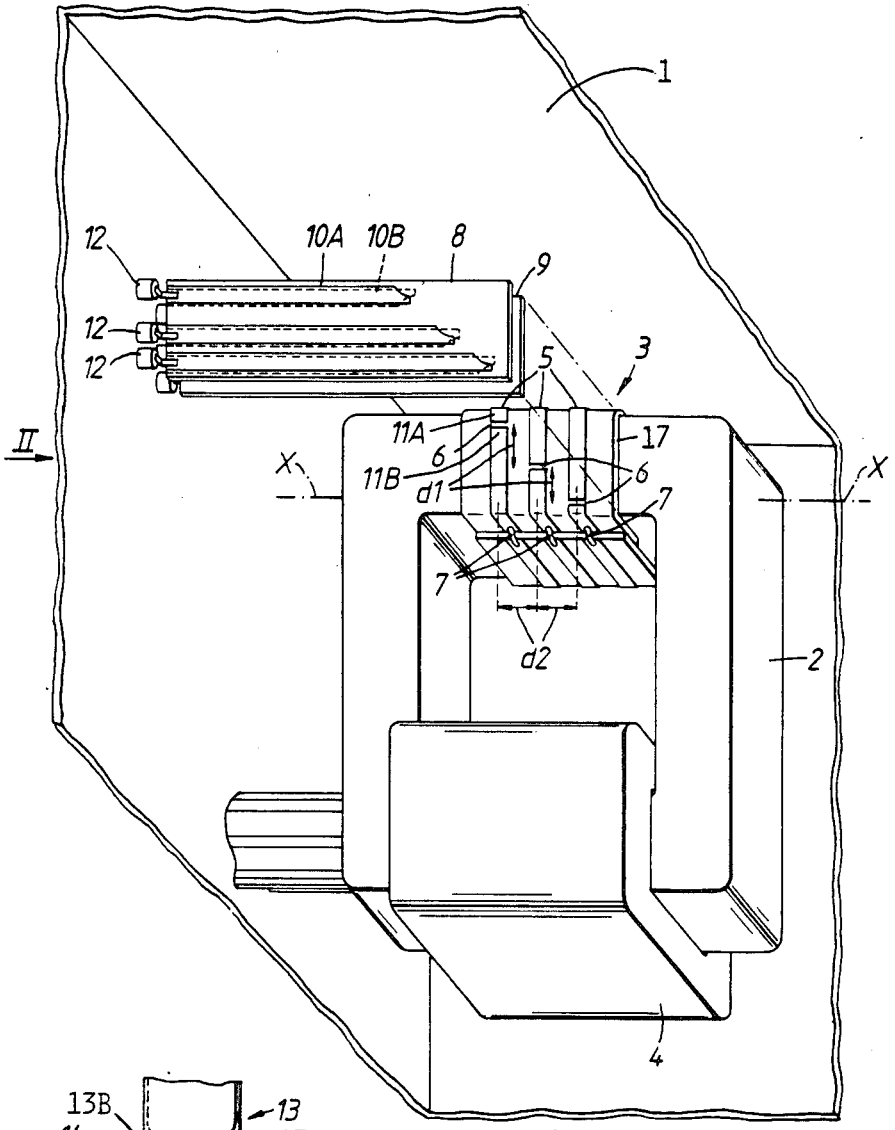
FIG. 1 is a schematic perspective view of a transformer constructed in accordance with the invention, shown in exploded form with its casing partly broken away.

Referring to the drawings, the transformer is enclosed within an insulating casing of which a small section is shown at 1 and which is filled with oil. Inside the casing is a closed rectangular magnetic core 2. Around each of two opposite sides of this core 2 is wound an inner primary assembly 3 and an outer secondary 4. One of these secondaries has been removed from the illustrated transformer to reveal the primary assembly under it. Each secondary has a low voltage end at the right hand side as seen in the drawing and a high voltage end at the left hand side, the secondaries being wound progressively from one side to the other so as to minimise the effects of high voltages at the left hand side where the feed lines to the primary assembly are located. Each primary assembly is composed of an insulating sheet 17 which is bent around one side of the core 2. The insulating sheet 17 is formed as a printed circuit board and carries a number of conductive tracks 5 each defining a space 6. Where the edges of the sheet 17 overlap, the conductive tracks 5 are soldered so as to bridge the adjacent parts of the conductive tracks. These soldered connections are shown at 7. It is preferred that the conductive tracks be formed on both sides of the sheet 17 but this is not essential. If conductive tracks are formed on both sides however, a further sheet of insulating material should be interposed between the sheet 17 and the core 2.

From the drawing it will be apparent that the conductive tracks 5 on the insulating sheet 17 form single loop primary circuits. These have to be connected to outside the casing 1 by transmission lines which are matched to the impedance of the respective primaries. The way in which primaries are formed enables this to be done in a particularly effective manner using a further printed circuit board 8 which rests against the insulating sheet 3 with the inter-position of an insulator 9. The conductive tracks on the circuit board 8 are formed on opposite sides thereof and define balanced feed lines one of which is indicated by reference numerals 10A and 10B. The right-hand ends of these lines are shaped as shown so as to allow connection to corresponding ends 11A and 11B of an associated primary winding. Suitable holes may be formed through the circuit board 8 and insulator 9 to effect such connections e.g. by soldering.

It will be noted that the gaps 6 between the ends of the primary windings are staggered, being spaced by distances d1 around a common axis x—x of the primaries. The distance d1 is equal to the distances between the balanced line pairs 10A, 10B etc. Also these balanced lines, which extend in the direction of the aforementioned axis, have different lengths. The lengths differ by distances d2 equal to the spacing of the primaries in the direction of the axis so that their right-hand ends are staggered and lie directly on top of the ends (e.g. 11A and 11B) of the primaries.

Figure 2:
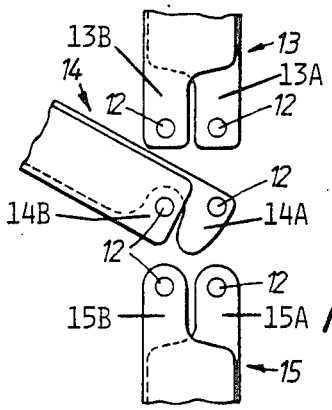
FIG. 2 is a view of the outside of the casing as seen in direction II as indicated on FIG. 1.

The transmission lines and the board 8 on which they are carried extend from the left hand low voltage side of the transformer, in the direction of the axis x—x, which is common to the primaries on sheet 17, to studs 12 which extend through the transformer casing 1. These studs are connected to a further circuit board similar to that shown at 8 either directly or through the intermediary of an edge connector (not shown). A method of direct connection is shown in FIG. 2 where the studs 12 are connected to balanced transmission lines 13, 14 and 15 formed by tracks 13A, 13B; 14A, 154B and 15B on an insulating board, not shown. The lines 13, 14 and 15 are connected at their other ends, not shown, in parallel with respective lines connected to the primaries on the lower side of the transformer (which are identical to those on the upper side). The two secondaries are also connected in parallel and their output is connected in this particular embodiment of the invention to the output stage of a radar transmitter.

I claim:

1. A transformer comprising:

a. a core;

b. a first insulating sheet extending around said core and a plurality of co-axial conductive tracks carried by said first insulating sheet, each conductive track forming a primary of the transformer and each having adjacent ends separated by a gap, the gaps of the different primaries being staggered from one another circumferentially relative to a common axis of the primaries;

c. a secondary extending around said core so as to be inductively coupled to said primaries;

d. a second insulating sheet lying substantially against the first insulating sheet and carrying pairs of conductors, each pair comprising a conductor disposed on each side of said second insulating sheet and defining a balanced transmission line, said transmission lines having respective ends which are staggered relative to one another so that the end of each said transmission line terminates at a position adjacent to a respective one of said gaps; and e. means connecting the conductors of each said pair to a respective one of said adjacent ends of the associated primary.

2. A transformer according to claim 1, further comprising a housing provided with terminals, wherein said balanced transmission lines lead from said primaries to the terminals of said housing.

3. A transformer according to claim 1 wherein said second insulating sheet and the conductors thereon extend in the direction of said common axis and in which one end of said second insulating sheet is located between said primaries and said secondary.

4. A transformer according to claim 3, further comprising a housing provided with terminals, wherein said balanced transmission lines lead from said primaries to the terminals of said housing.

* * * * *